United States Patent [19]

White

[11] 4,274,686

[45] Jun. 23, 1981

[54] FREE ARM SEWING MACHINE CABINET MOUNTING MECHANISM

[76] Inventor: Ralph B. White, 2526 Castle Dr., Fort Wayne, Ind. 46816

[21] Appl. No.: 56,547

[22] Filed: Jul. 11, 1979

[51] Int. Cl.[3] ..... A47B 81/00

[52] U.S. Cl. ..... 312/27; 312/22; 112/217.1

[58] Field of Search ..... 312/21-24, 312/27-30; 112/217.1, 258, 260

[56] References Cited

U.S. PATENT DOCUMENTS

| | | | |
|---|---|---|---|
| Re. 28,835 | 1/1976 | Roberts et al. | 312/29 |
| 3,870,386 | 3/1975 | Shephard | 312/30 |
| 3,986,755 | 10/1976 | Kohara | 312/21 |
| 4,005,918 | 2/1977 | Smith et al. | 312/27 |
| 4,089,573 | 5/1978 | Aeschliman | 312/27 |
| 4,108,512 | 8/1978 | White | 312/24 |
| 4,132,454 | 1/1979 | Johnson | 312/27 |
| 4,135,463 | 1/1979 | Nacasse | 312/29 |

*Primary Examiner*—Casmir A. Nunberg
*Attorney, Agent, or Firm*—Gust, Irish, Jeffers & Hoffman

[57] ABSTRACT

A mechanism for mounting a free arm sewing machine in a cabinet such that the machine is selectively movable to an upper use position, a lower use position and a storage position. The mechanism includes a sewing machine support platform which is pivotally connected to a lower arm, the latter being pivotally connected to an upper arm at a point intermediate the ends of the upper arm. The upper arm, in turn, is pivotally connected to and depending from the underneath side of the sewing machine cabinet top. In the storage position, the sewing machine is entirely disposed beneath the cabinet top, and the platform and lower arm are substantially parallel and inclined relative to the vertical direction so that the machine can be easily lifted by the user to the lower use position. In the lower use position, the platform and lower arm are also parallel, with the platform front edge being supported by a notched bracket and the rear edge being supported on the lower arm. In the upper use position, the platform front edge is supported in a higher notch in the bracket with the rear edge being supported by means of a rearwardly extending plate supported on the upper end of the upper arm. In order to prevent the machine from rotating downwardly when in the storage position, the rearwardly extending plate is received in locking position between the lower arm and the lower end of the upper arm. Springs coiled around the rods defining the pivots for the upper and lower arms urge the mechanism to rotate in a direction toward the upper use position so that the major portion of the weight of the machine need not be supported by the user when moving it from one position to another.

29 Claims, 10 Drawing Figures

FREE ARM SEWING MACHINE CABINET MOUNTING MECHANISM

BACKGROUND OF THE INVENTION

The present invention relates to a mechanism for mounting a free arm sewing machine in a cabinet such that the machine is movable to an upper use position, a lower use position and a storage position.

Many sewing machines presently on the market are of the free arm type which include a relatively narrow arm positioned above the bed or base of the machine and adapted to receive tubular portions of garments, such as sleeves and trouser legs. When the machine is to be utilized as a conventional flat bed machine, it is desirable for the upper surface of the free arm to be disposed at a level flush with the working surface of the cabinet top. In order for the machine to assume this position, many prior art machines provide a mechanism whereby the machine can be lowered into the cabinet and locked in place. Since the free arm is often narrower than the opening in the cabinet top, removable or drop-away inserts are customarily positioned between it and the sides of the cabinet opening. This provides a continuous work surface flush with the needle plate and the machine may then be operated as a conventional flat bed machine.

When the machine is not in use, most prior art mounting mechanisms are designed such that the machine can be dropped away completely below the working surface of the cabinet, and the hinged cover is then folded over the opening in the cabinet top. Although most prior art machines are horizontal when they are moved to their storage positions, this often makes it difficult to pull them upwardly to the lower use position. This is particularly true in the case of prior art mechanisms where no mechanical lifting assist is provided.

Perhaps the greatest problem with prior art free arm mounting mechanisms is their complexity. This arises from the nature of the mechanism itself which must be capable of supporting and locking the machine in three distinct positions, with one of the positions being a storage position wherein economy of space is an important factor. One such prior art mechanism is disclosed in U.S. Pat. No. 4,005,918 and comprises a first panel pivotally connected to the cabinet for rotating the machine from the storage position to the lower use position. The machine support platform is pivotally connected to the first panel and is supported on the first panel in the upper use position by a relatively complex rod arrangement. In the storage position, the machine is disposed horizontally and no mechanical assist, such as a spring assist, is provided to support its weight during movement between the various positions.

SUMMARY OF THE INVENTION

The present invention comprises a mounting mechanism for a free arm sewing machine which overcomes the problems and disadvantages of prior art mechanisms by providing a relatively simple and easy to operate mechanism capable of positively locking the machine in the upper use, lower use and storage positions without the necessity for complicated mechanical contrivances.

The mechanism basically comprises a first support arm pivotally connected to the cabinet, a second support arm pivotally connected to the first arm at a pivot point intermediate the opposite ends of the first cam, and a sewing machine support platform which is pivotally connected to the second arm at a point intermediate the front and rear edges of the platform. The platform and machine are supported in the upper use position by means of a rearwardly extending plate resting on the upper end of the first arm and by means of a locking member extending outwardly from the platform and received in a notch in a support bracket connected to the cabinet. In the lower use position, the platform is supported on the second arm, and the front edge thereof is supported by means of the aforementioned locking member being received in a lower notch in the support bracket. In the storage position, the machine and platform are disposed completely beneath the cabinet top with the platform being inclined relative to the vertical direction so that the machine may easily be pulled upwardly to the lower use position. In order to prevent the weight of the machine from causing the platform to rotate downwardly when in the storage position, the aforementioned rearwardly extending plate is received in locking position between the second arm and the lower end of the first arm. Adjustably tensioned springs provide mechanical assistance for supporting the weight of the machine during movement between the storage, lower use and upper use positions.

Specifically, the present invention contemplates a mounting mechanism for supporting a free arm sewing machine selectively in an upper use position, a lower use position and a storage position. The mechanism comprises an upper support arm pivotally connected to and depending from the cabinet top, a lower support arm pivotally connected to the first support arm, a sewing machine support platform pivotally connected to the lower support arm, and a lock member connected to and extending outwardly from an edge of the platform and being near the platform front edge. Lower use support means supports the platform in a lower use position in which the platform is aligned with and below the opening in the cabinet top and comprises lower catch means for releasably supporting the lock member such that the platform is supported in the lower use position on the lower catch means and the lower arm. Upper use support means support the platform in the upper use position in which the platform is aligned with the opening in the cabinet top and is at or near the level of the cabinet top. The upper use support means comprises upper catch means for releasably supporting the lock member, and further comprises rest means connected to the cabinet top and having an upper surface adjacent an edge of the opening for supporting the rear edge portion of the platform. The mechanism is movable to a storage position wherein the platform is positioned such that a sewing machine attached thereto is disposed completely beneath the cabinet top.

The mechanism according to the present invention is characterized by simplicity of structure and ease of operation. Furthermore, the degree of mechanical assist for supporting the machine as it is moved from one position to another can be easily adjusted so that the mechanism will perform satisfactorily with machines of different weights.

The machine can be locked and unlocked from its positions and moved from one position to another merely by applying pressure to the machine itself, as opposed to some prior art mechanisms wherein operations other than movement of the machine itself are necessary to lock and unlock the mechanism. Furthermore, the present mechanism is easily adaptable to existing sewing machines and sewing machine cabinets without the necessity for extensive modifications.

DETAILED DESCRIPTION

Figure 1:
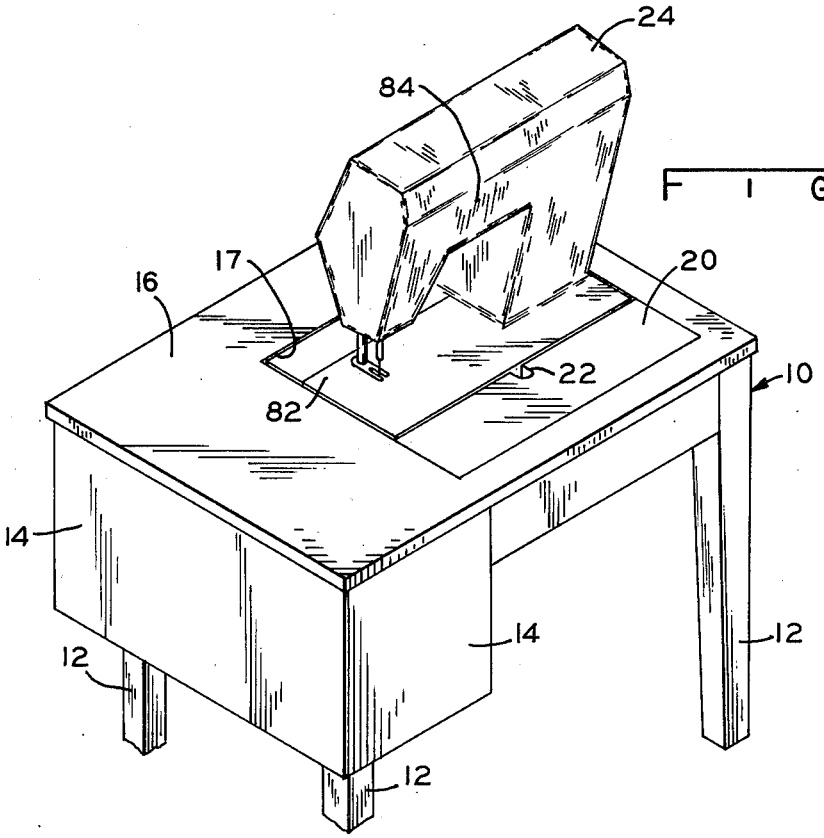
FIG. 1 is a perspective view of a free arm sewing machine mounted in a cabinet and in its lower use position.
Figure 2:
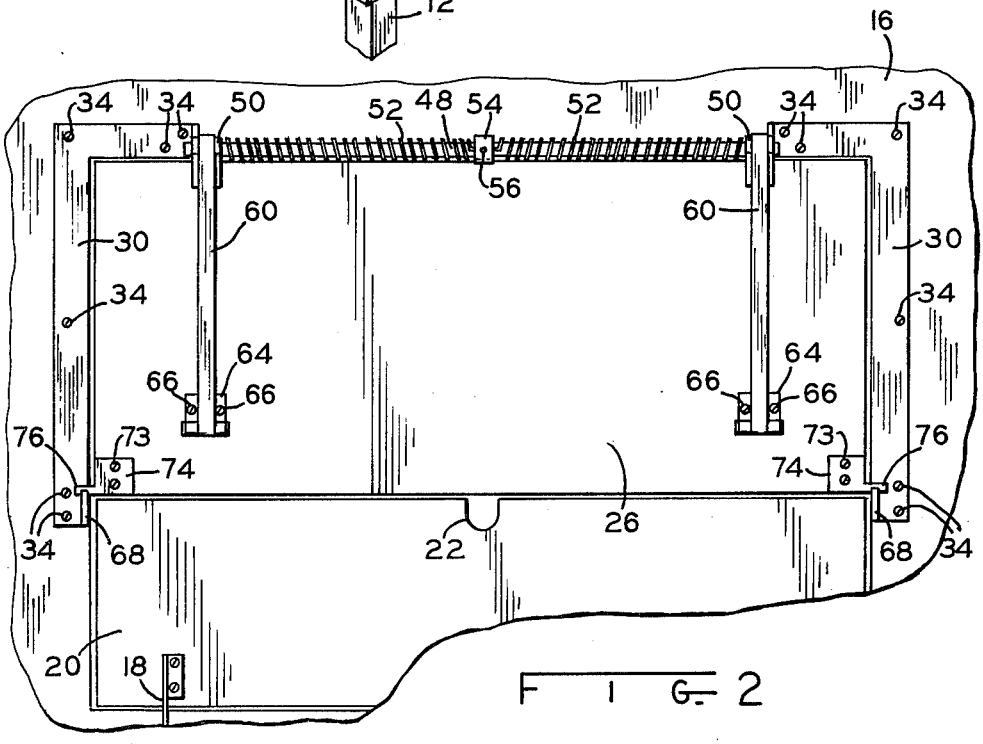
FIG. 2 is a bottom view of the mechanism in the lower use position.

With reference now to the drawings, FIG. 1 illustrates a sewing machine cabinet 10, generally made of wood, comprising legs 12, sides 14, and a top 16 having an opening 17 therein. Connected to top 16 by hinges 18, is a flip board 20 having a notch 22 therein to enable it to be raised by the user. A standard sewing machine 24 is connected to a wooden support platform 26 (FIG. 2). Although a separate platform 16 is referred to throughout the specification and claims for supporting the machine 24, it is possible to mount the sewing machine 24 directly to the supporting mechanism to be described hereinafter such that the base 28 of the machine then becomes the "platform".

Figure 3:
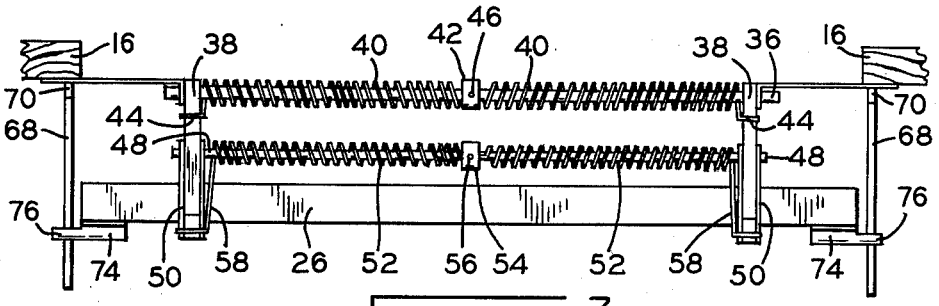
FIG. 3 is a rear elevational view of the mechanism in the lower use position.

The supporting mechanism for platform 26 and machine 24 includes stationary L-shaped brackets 30, which are mounted directly to the underneath side 32 of cabinet top 16 by screws 34 (FIG. 2). Pivotally received within openings in brackets 30 is an upper rod 36 to which is rigidly connected a pair of upper arms 38, as by rivets 39. Coiled around upper rod 36 are springs 40, which are wound in opposite directions. The inner ends of springs 40 abut against the cabinet top 16 and their outer ends 44 are hooked around upper arms 38 as shown in FIG. 3. Collar 42 serves as a spacer and is locked to rod 36 by means of set screw 46.

A lower rod 48 is rigidly connected to upper arms 39 by means of rivets 49 or the like, and also passes through a pair of yokes 50, which are rotatably suspended from lower rod 48. Springs 52 are coiled around lower rod 48 in opposite directions, and their inner ends are received within notches (not shown) in locking collar 54, which is adjustably secured to lower rod 48 by set screw 56. The outer ends 58 of springs 52 are hooked around the lower ends of yokes 50.

Springs 40 are tensioned such that upper arms 38 are resiliently urged to rotate in the counterclockwise direction as viewed in FIGS. 5 through 10, and lower springs 52 are tensioned such that yokes 50 are also resiliently urged to rotate in the counterclockwise direction as viewed in FIGS. 5 through 10.

A pair of lower arms 60 (FIG. 2) are rigidly secured to yokes 50 by rivets 62, or any other suitable fastening means, and are rotatably connected at their other ends to platform 26 by hinges 64, the latter being rigidly connected to platform 26 by screws 66. Thus, platform 26 is capable of rotational movement relative to lower arms 60 about the pivot axis defined by hinges 64.

Figure 5:
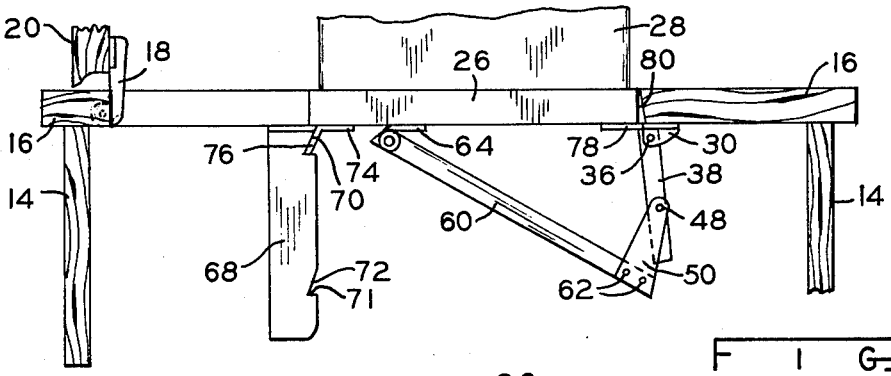
FIGS. 5 through 8 are sectional view of the cabinet and mechanism showing the sequential movements of the mechanism from the upper use position to the lower use position.
Figure 6:
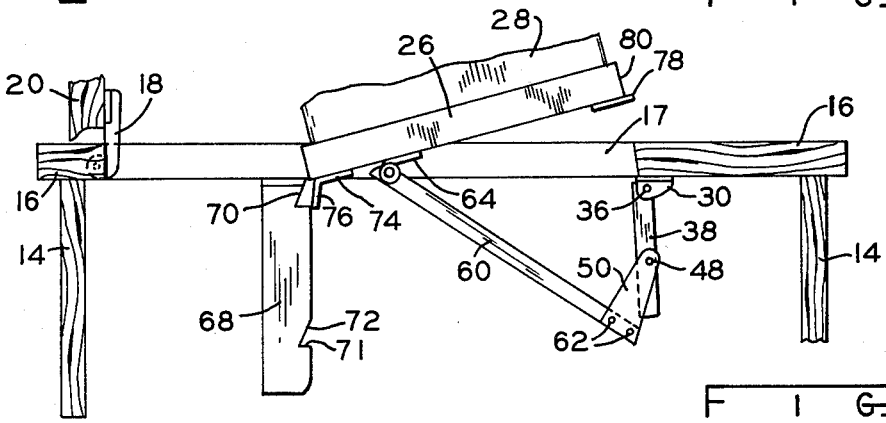
Figure 7:
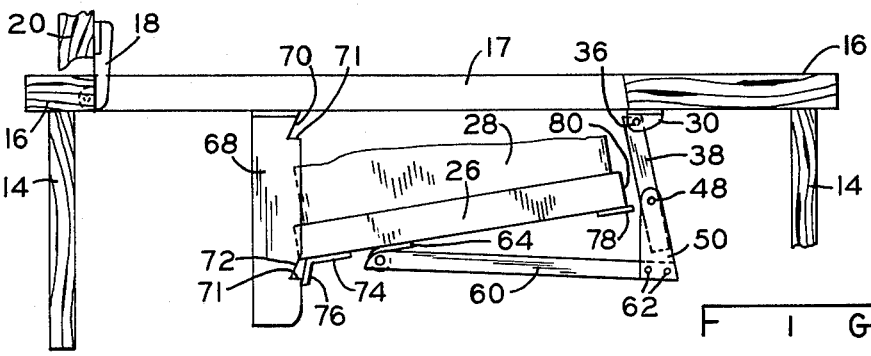
Figure 8:
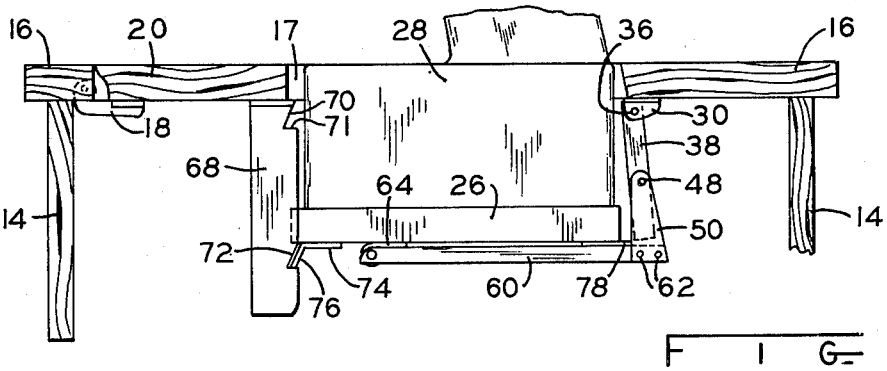

Stationary brackets 30 each include integral, depending locking brackets 68 having upper and lower notches 70 and 72, respectively, therein (FIGS. 5 through 10). Secured to the underneath side 32 of platform 26 by screws 73 are locking tabs 74 extending forwardly and to the sides of platform 26 and which include respective downwardly angled portions 76. Locking tab 74 is positioned such that the edges of angled portions 76 engage and are supported by the horizontal surfaces 71 of notches 70 and 72 when the mechanism is in the upper use and lower use positions, respectively. FIG. 5 illustrates the mechanism in the upper use position wherein locking tabs 74 are seated within upper notches 70, and FIG. 8 illustrates the mechanism in the lower use position in which the locking tabs 74 are seated in the lower notches 72.

Connected to the rear portion of the underneath side 32 of platform 26 are metal plates 78, which protrude slightly beyond the rear edge 80 of platform 26.

The movement of the support mechanism between the upper use, lower use and storage positions will now be described with particular reference to FIGS. 5 through 10.

FIG. 5 illustrates the mechanism in the upper use position wherein the free arm 82 of the machine 24 is positioned above cabinet top 16. In this position, platform 26 is supported flush with cabinet top 16 by virtue of locking tabs 74 being seated within upper notches 70, and plates 78, which protrude slightly beyond rear edge 80 of platform 26, resting on the upper ends 81 of upper arms 38. The rear edge 19 of cabinet opening 17 is bevelled to accommodate plates 78. Lower arms 60 extend downwardly at an angle relative to platform 26.

To move the mechanism from the upper use to the lower use position illustrated in FIG. 8, the sewing machine 24 is tilted forwardly until the angled portions 76 of locking tabs 74 clear upper notches 70, as illustrated in FIG. 6. Since the supporting surfaces 71 of notches 70 and 72 are horizontal, tabs 71 can disengage from them easily. This permits the platform 26 to be lowered until locking tabs 74 are aligned with lower notches 72. Machine 24 is then tilted rearwardly so that the angled portions 76 of locking tabs 74 enter and are seated within lower notches 72. The machine 24 and platform 26 can then assume a vertical position by permitting the platform 26 and machine 24 to rotate further until plates 78 are seated on lower arms 60, as illustrated in FIGS. 7 and 8. In this position, the platform 26 is supported on its front edge by locking tabs 74, and is suspended from stationary brackets 30 by yokes 50 and arms 38 and 60.

By properly adjusting the tension of springs 40 and 52, the major portion of the weight of machine 24 can be supported as it is moved from the upper use to the lower use position. This adjustable tensioning feature is an important aspect of the mechanism.

Figure 9:
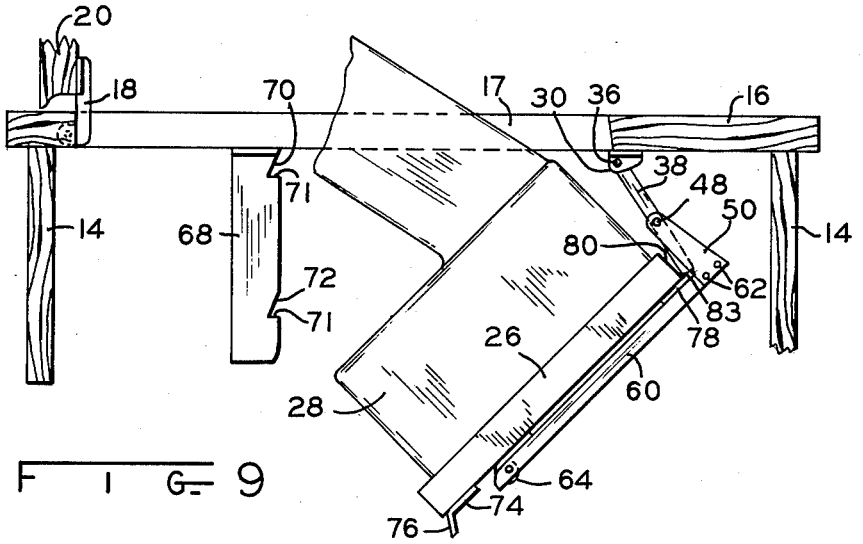
FIGS. 9 and 10 are sectional views similar to FIGS. 5 through 8 showing the mechanism and machine moving into the storage position.
Figure 10:
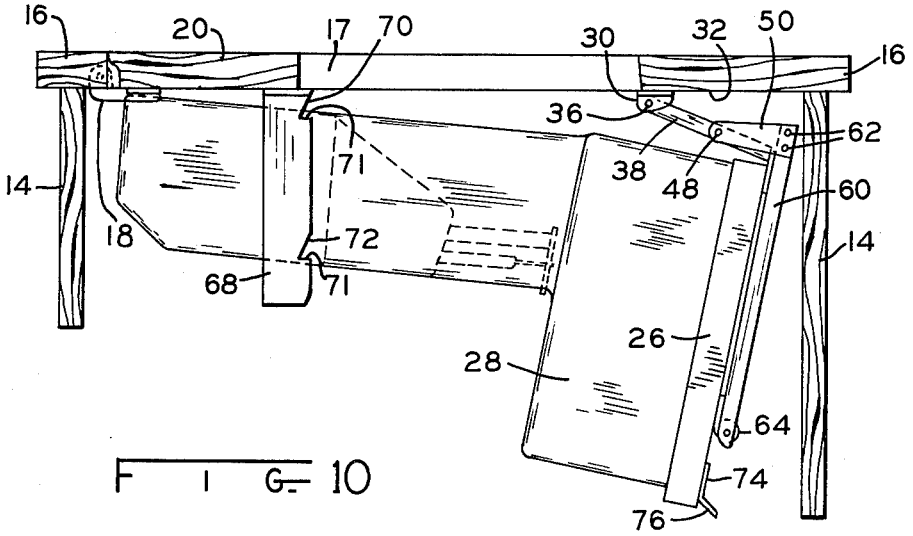
Figure 4:
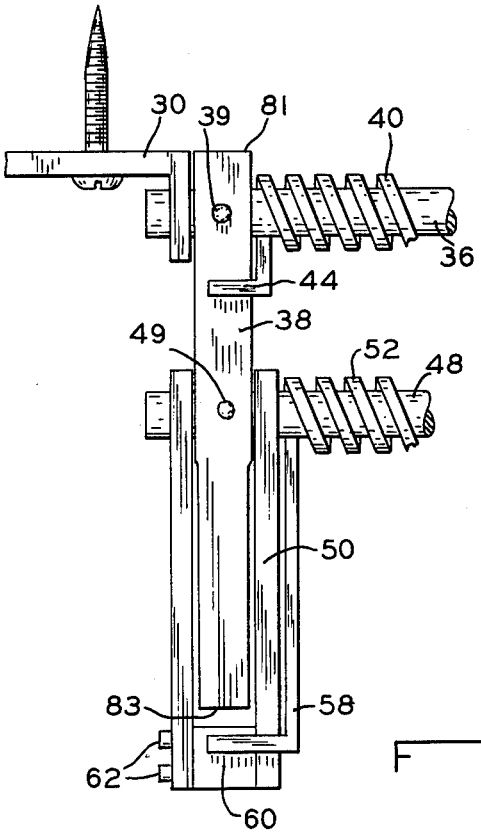
FIG. 4 is an enlarged detail of the inner connections between the upper and lower support arm.

The mechanism is moved from the lower use position of FIG. 8 to the storage position of FIG. 10 by first tilting the machine 24 rearwardly and then tilting it forwardly to cause locking tabs 74 to move out of lower notches 72, as shown in FIG. 7. This is essentially the same position that the mechanism assumes as it moves from the upper use to the lower use position. When the angled portions 76 of locking tabs 74 clear lower notches 72, the machine 24 and mechanism is lowered slightly so that upper arms 38 extend slightly forward of yokes 50. The machine is then tilted rearwardly so as to cause plates 78 to snap over upper arms 38 and be received between the lower ends 83 of upper arms 38 and lower arms 60 as illustrated in FIG. 9. The machine is then lowered against the tension of springs 40 and 52 to the storage position illustrated in FIG. 10. It will be noted that when the machine is in the storage position, it occupies a minimum of space beneath cabinet top 16 so that ample leg room for a person seated at the sewing cabinet 10 is provided. Platform 26 is prevented from rotating downwardly under the weight of the machine 24 by virtue of plates 78 being retained between upper arms 38 and lower arms 60 (FIG. 9).

To move the machine from the storage position of FIG. 10 to the lower use position of FIG. 8, the upper arm portion 84 of machine 24 is grasped and the machine is pulled upwardly until locking tabs 74 snap into lower notches 72. To bring the machine 24 into the upper use position, the machine is tilted rearwardly so that locking tabs 74 withdraw from lower notches 72 as illustrated in FIG. 7, the machine 24 and mechanism is lifted upwardly with the assist of springs 40 and 52 to the position shown in FIG. 6, and is then rotated rearwardly so that locking tabs 74 will be seated within upper notches 70.

The use of three separate pivot axes to connect platform 26 to the cabinet is important because it enables breaking of the circular path of the platform relative to the cabinet in the upper and lower locked positions, and permits the platform 26 to be aligned with the opening in the cabinet in both positions. Because pivot 48 breaks the normal circular path followed by platform 26, it allows the platform 26 to be moved in a vertical direction between the upper and lower use positions.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a sewing machine cabinet having a top with an opening therein, a mounting mechanism for supporting a free arm sewing machine selectively in an upper use position, a lower use position, and a storage position, said mechanism comprising:

an upper support arm pivotally connected to and depending from said cabinet top, a lower support arm pivotally connected to said upper support arm, a sewing machine support platform pivotally connected to said lower support arm, lower use lock means for releasably locking said platform in a lower use position, and upper use lock means for releasably locking said platform in an upper use position, the upper use position of said platform being generally above the lower use position thereof, said mechanism being movable to a storage position wherein the platform is positioned such that a sewing machine operably attached thereto would be disposed below the cabinet top.

2. The mechanism of claim 1 wherein said upper and lower use lock means include: bracket means connected to said cabinet, and a lock member connected to said platform, said lock member being releasably engageable with an upper catch and a lower catch of said bracket means when said platform is in the upper use position and the lower use position, respectively.

3. The mechanism of claim 2 including a plate connected to said platform and protruding rearwardly beyond said platform, said plate resting on the end of said upper support arm when said platform is in the upper use position.

4. The mechanism of claim 1 wherein said upper and lower use lock means comprise bracket means having an upper notch and a lower notch therein, and including a tab member connected to said platform and engageable with said upper and lower notches when said platform is in the upper use and lower use positions, respectively.

5. The mechanism of claim 1 including: a pair of brackets connected to said cabinet, a first rod connected to one of said upper support arm and said brackets and pivotally connected to the other of said upper support arm and said brackets so as to pivotally connect said upper support arm to said cabinet top, and spring means coiled around said first rod and connected to said upper arm for urging said upper arm in a direction causing said platform to move upwardly toward the upper use position.

6. The mechanism of claim 5 wherein said spring means comprises a pair of springs connected together and coiled in opposite directions so as to balance the tension on said first rod.

7. The mechanism of claim 6 including means for spacing said springs comprising a collar on said rod.

8. The mechanism of claim 5 including: a second rod connected to one of said upper support arm and said lower support arm and pivotally connected to the other of said upper arm and said lower arm so as to pivotally connect said lower arm to said upper arm, and spring means coiled around said second rod and connected to said lower arm for urging said lower arm to rotate in the same direction as said upper arm is urged to rotate.

9. The mechanism of claim 8 wherein said spring means comprises a pair of springs connected together and coiled in opposite directions so as to balance the tension on said first rod.

10. The mechanism of claim 9 including means for adjusting the tension of said springs comprising a collar circumferentially adjustable on said first rod.

11. The mechanism of claim 8 wherein said lower arm is pivotally connected to said second rod by means of a yoke which is rigidly connected to said lower arm and which rotatably receives said second rod.

12. In a sewing machine cabinet having a top with an opening therein, a mounting mechanism for supporting a free arm sewing machine selectively in an upper use position, a lower use position, and a storage position, said mechanism comprising:

an upper support arm pivotally connected to and depending from said cabinet top, a lower support arm pivotally connected to said upper support arm, a sewing machine support platform pivotally connected to said lower support arm, said platform having a front edge, a rear edge, and said edges, a lock member connected to and extending outwardly from an edge of the platform and being near the platform front edge, lower use support means for supporting said platform in a lower use position in which the platform is aligned with and below the opening in the cabinet top, said lower use support means comprising lower catch means for releasably supporting said lock member, said platform being supported in a lower use position by said lower catch means and said lower arm, and upper use support means for supporting said platform in an upper use position in which the platform is aligned with the opening in the cabinet top and is at or near the level of the cabinet top, said upper use support means comprising upper catch means for releasably supporting said lock member and further comprising rest means connected to said cabinet top and having an upper surface adjacent an edge of said opening for supporting the rear edge portion of said platform, said mechanism being movable to a storage position wherein the platform is positioned such that a sewing machine attached thereto would be disposed below the cabinet top.

13. The mechanism of claim 12 wherein said rest means comprises an end of said upper support arm.

14. The mechanism of claim 13 including a plate connected to said platform and protruding rearwardly beyond the rear edge of said platform, said plate resting on the end of said upper support arm when said platform is in the upper use position.

15. The mechanism of claim 12 including: two said upper support arms being laterally spaced apart, two said lower support arms being laterally spaced apart, and two said lock members being laterally spaced apart.

16. The mechanism of claim 12 wherein said upper and lower catch means together comprise a bracket having an upper notch and a lower notch therein, and said lock member comprises a tab member connected to said platform.

17. The mechanism of claim 16 wherein said tab member extends laterally of one of the platform side edges and forwardly of the platform front edge, and includes a downwardly angled portion which is received in said upper notch and said lower notch in the upper use and lower use positions, respectively.

18. The mechanism of claim 16 wherein said notches have lower surfaces which are substantially flat and substantially horizontal, and said tab member includes a downwardly angled portion having a front edge received in said upper and lower notches in the upper and lower use positions, respectively.

19. The mechanism of claim 12 including storage lock means associated with said platform and said upper and lower arms for locking said platform to said lower arm and against rotation relative to said lower arm when said platform is in the storage position.

20. The mechanism of claim 19 wherein said storage lock means comprises a tab extending beyond an edge of said platform and receivable in locked position between said upper and lower arms.

21. The mechanism of claim 20 wherein said platform has an underneath side, said tab is connected to the underneath side of said platform and extends rearwardly from said platform.

22. In a sewing machine cabinet having a top with an opening therein, a mounting mechanism for supporting a free arm sewing machine selectively in an upper use position, a lower use position, and a storage position, said mechanism comprising:

an upper support arm having an upper end and a lower end and pivotally connected to and depending from said cabinet top, a lower support arm, means for pivotally connecting said lower arm to said upper arm at a pivot point along said upper arm intermediate its ends, a sewing machine support platform having a front edge, a rear edge and side edges, said platform being pivotally connected to said lower arm at a pivot point intermediate the front and rear edges of said platform, a lock member connected to and extending outwardly from an edge of said platform and being near the front edge of said platform, lower use support means for supporting said platform in a lower use position in which the platform is aligned with and below the opening in the cabinet top, said lower use support means comprising lower catch means for realeasably supporting said lock member, said platform being supported in said lower use position by said lower catch means and said lower arm, upper use support means for supporting said platform in an upper use position in which the platform is aligned with the opening in the cabinet top and is at or near the level of the cabinet top, said upper use support means comprising upper catch means for releasably supporting said lock member, said mechanism being movable to a storage position wherein the platform is positioned such that a sewing machine attached thereto would be disposed below the cabinet top, and a storage lock member connected to said platform and extending from an edge thereof and receivable in locked position between said upper arm and said lower arm when the mechanism is in the storage position so as to prevent said platform from rotating relative to said lower arm.

23. The mechanism of claim 22 wherein said platform has an underneath side, said storage lock member comprises a plate connected to said underneath side and extending rearwardly of said platform rear edge, said plate being lockingly received between said lower arm and the lower end of said upper arm when said mechanism is in the storage position.

24. The mechanism of claim 23 wherein said plate rests on the upper end of said upper arm when said platform is in the upper use position.

25. The mechanism of claim 23 including: two said upper arms being laterally spaced apart, two said lower arms being laterally spaced apart, two said lock members being laterally spaced apart, and two said plates being laterally spaced apart and receivable respectively between said upper arms and lower arms.

26. The mechanism of claim 22 including: a pair of brackets connected to said cabinet, a first rod connected to one of said upper support arm and said brackets and pivotally connected to the other of said upper support arm and said brackets so as to pivotally connect said upper support arm to said cabinet top, and spring means coiled around said first rod and connected to said upper arm for urging said upper arm in a direction causing said platform to move upwardly toward the upper use position.

27. The method of claim 26 wherein said means for pivotally connecting said lower arm to said upper arm comprises a second rod connected to one of said upper arm and said lower arm and pivotally connected to the other of said upper arm and said lower arm so as to pivotally connect said lower arm to said upper arm, and spring means coiled around said second rod and connected to said lower arm for urging said lower arm to rotate in the same direction as said upper arm is urged to rotate.

28. The mechanism of claim 22 wherein said means for pivotally connecting said lower arm to said upper arm comprises a yoke connected to said lower arm and pivotally connected to said upper arm, said yoke straddling the portion of said upper arm between said pivot point and said upper arm lower end.

29. The mechanism of claim 22 wherein said platform is inclined relative to the vertical direction when in the storage position.

* * * * *

UNITED STATES PATENT OFFICE

CERTIFICATE OF CORRECTION

Patent No. 4,274,686 Dated June 23, 1981

Inventor(s) Ralph B. White

It is certified that error appears in the above-identified patent and that said Letters Patent are hereby corrected as shown below:

Column 1, line 67, change "cam" to --arm--.

Column 3, line 49, change "39" to --38--.

Claim 12, Column 6, line 63, change "said" to --side--.

Claim 22, Column 8, line 20, change "realeasably" to --releasably--.

Signed and Sealed this

Twentieth Day of October 1981

[SEAL]

Attest:

GERALD J. MOSSINGHOFF

Attesting Officer

Commissioner of Patents and Trademarks

REEXAMINATION CERTIFICATE (237th)

United States Patent [19]

White

[11] B1 4,274,686

[45] Certificate Issued Aug. 28, 1984

[54] FREE ARM SEWING MACHINE CABINET MOUNTING MECHANISM

[76] Inventor: Ralph B. White, 2526 Castle Dr., Fort Wayne, Ind. 46816

Reexamination Request:
No. 90/000,267, Oct. 5, 1982

Reexamination Certificate for:

| | |
|---|---|
| Patent No.: | **4,274,686** |
| Issued: | **Jun. 23, 1981** |
| Appl. No.: | **56,547** |
| Filed: | **Jul. 11, 1979** |

Certificate of Correction issued Oct. 20, 1981.

[51] Int. Cl.[3] ..... A47B 81/00
[52] U.S. Cl. ..... 312/27; 312/22; 112/217.1
[58] Field of Search ..... 312/23, 24, 27; 248/219.4

[56] References Cited

U.S. PATENT DOCUMENTS

| | | | |
|---|---|---|---|
| Re. 28,835 | 6/1976 | Roberts et al. | 312/29 |
| 2,233,548 | 3/1941 | Mroziak | 248/219.4 |
| 3,870,386 | 3/1975 | Shepherd | 312/30 |
| 3,986,755 | 10/1976 | Kohara | 312/21 |
| 4,089,573 | 5/1978 | Aeschliman | 312/27 |
| 4,108,512 | 8/1978 | White | 312/24 |
| 4,132,454 | 1/1979 | Johnson et al. | 312/27 |
| 4,135,463 | 1/1979 | Lacasse | 312/29 |

*Primary Examiner*—Victor N. Sakran

[57] ABSTRACT

A mechanism for mounting a free arm sewing machine in a cabinet such that the machine is selectively movable to an upper use position, a lower use position and a storage position. The mechanism includes a sewing machine support platform which is pivotally connected to a lower arm, the latter being pivotally connected to an upper arm at a point intermediate the ends of the upper arm. The upper arm, in turn, is pivotally connected to and depending from the underneath side of the sewing machine cabinet top. In the storage position, the sewing machine is entirely disposed beneath the cabinet top, and the platform and lower arm are substantially parallel and inclined relative to the vertical direction so that the machine can be easily lifted by the user to the lower use position. In the lower use position, the platform and lower arm are also parallel, with the platform front edge being supported by a notched bracket and the rear edge being supported on the lower arm. In the upper use position, the platform front edge is supported in a higher notch in the bracket with the rear edge being supported by means of a rearwardly extending plate supported on the upper end of the upper arm. In order to prevent the machine from rotating downwardly when in the storage position, the rearwardly extending plate is received in locking position between the lower arm and the lower end of the upper arm. Springs coiled around the rods defining the pivots for the upper and lower arms urge the mechanism to rotate in a direction toward the upper use position so that the major portion of the weight of the machine need not be supported by the user when moving it from one position to another.

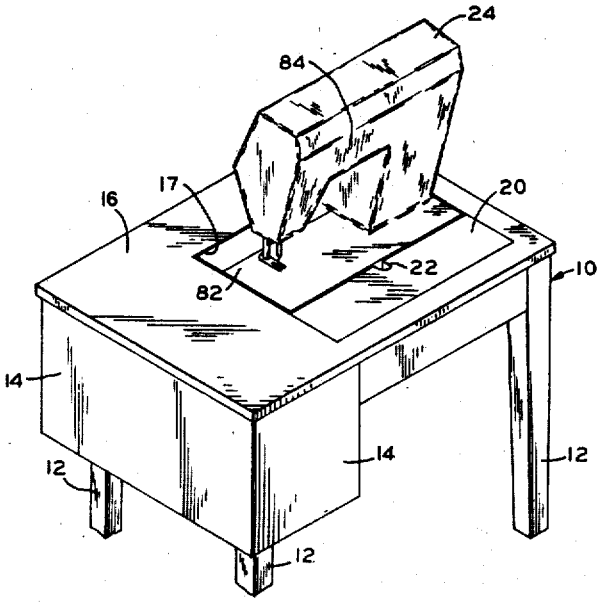

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

Claims 1–29 are cancelled.

New claims 30–38 are added and determined to be patentable.

*30. In a sewing machine cabinet having a top with an opening therein, a mounting mechanism for supporting a free arm sewing machine selectively in an upper use position, a lower use position, and a storage position, said mechanism comprising:*

*an upper support arm pivotally connected to and depending from said cabinet top,*

*a lower support arm pivotally connected to said upper support arm,*

*a sewing machine support platform pivotally connected to said lower support arm,*

*lower use lock means for releasably locking said platform in a lower use position,*

*upper use lock means for releasably locking said platform in an upper use position, the upper use position of said platform being generally above the lower use position thereof,*

*said mechanism being movable to a storage position wherein the platform is positioned such that a sewing machine operably attached thereto would be disposed below the cabinet top,*

*a pair of brackets connected to said cabinet, a first rod connected to one of said upper support arm and said brackets and pivotally connected to the other of said upper support arm and said brackets so as to pivotally connect said upper arm to said cabinet top, and first spring means coiled around said first rod and connected to said upper arm for urging said upper arm in a direction causing said platform to move upwardly toward the upper use position, and*

*a second rod connected to one of said upper support arm and said lower support arm and pivotally connected to the other of said upper arm and said lower arm so as to pivotally connect said lower arm to said upper arm, and second spring means coiled around said second rod and connected to said lower arm for urging said lower arm to rotate in the same direction as said upper arm is urged to rotate.*

*31. The mechanism of claim 30 wherein said first mentioned spring means comprises a pair of springs connected together and coiled in opposite directions so as to balance the tension on said first rod.*

*32. The mechanism of claim 31 including means for adjusting the tension of said springs comprising a collar circumferentially adjustable on said first rod.*

*33. The mechanism of claim 30 wherein said lower arm is pivotally connected to said second rod by means of a yoke which is rigidly connected to said lower arm and which rotatably receives said second rod.*

*34. In a sewing machine cabinet having a top with an opening therein, a mounting mechanism for supporting a free arm sewing machine selectively in an upper use position, a lower use position, and a storage position, said mechanism comprising:*

*an upper support arm having an upper end and a lower end and pivotally connected to and depending from said cabinet top,*

*a lower support arm,*

*means for pivotally connecting said lower arm to said upper arm at a pivot point along said upper arm intermediate its ends,*

*a sewing machine support platform having a front edge, a rear edge, side edges, and an underneath side, said platform being pivotally connected to said lower arm at a pivot point intermediate the front and rear edges of said platform,*

*a lock member connected to and extending outwardly from an edge of said platform and being near the front edge of said platform,*

*lower use support means for supporting said platform in a lower use position in which the platform is aligned with and below the opening in the cabinet top, said lower use support means comprising lower catch means for releasably supporting said lock member, said platform being supported in said lower use position by said lower catch means and said lower arm,*

*upper use support means for supporting said platform in an upper use position in which the platform is aligned with the opening in the cabinet top and is at or near the level of the cabinet top, said upper use support means comprising upper catch means for releasably supporting said lock member,*

*said mechanism being movable to a storage position wherein the platform is positioned such that a sewing machine attached thereto would be disposed below the cabinet top, and*

*a storage lock member comprising a plate connected to said underneath side of said platform and extending rearwardly of said platform rear edge, said plate being receivable in locked position between said lower arm and the lower end of said upper arm when said mechanism is in the storage position to thereby prevent said platform from rotating relative to said lower arm.*

*35. The mechanism of claim 34 wherein said plate rests on the upper end of said upper arm when said platform is in the upper use position.*

*36. The mechanism of claim 34 including two said upper arms being laterally spaced apart, two said lower arms being laterally spaced apart, two said lock members being laterally spaced apart, and two said plates being laterally spaced apart and receivable respectively between said upper arms and lower arms.*

*37. In a sewing machine cabinet having a top with an opening therein, a mounting mechanism for supporting a free arm sewing machine selectively in an upper use position, a lower use position, and a storage position, said mechanism comprising:*

*an upper support arm having an upper end and a lower end and pivotally connected to and depending from said cabinet top,*

*a lower support arm,*

*means for pivotally connecting said lower arm to said upper arm at a pivot point along said upper arm intermediate its ends, said connecting means comprising a first rod connected to one of said upper arm and said lower arm and pivotally connected to the other of said upper arm and said lower arm so as to pivotally connect said lower arm to said upper arm, and first spring*

*means coiled around said first rod and connected to said lower arm for urging said lower arm to rotate in the same direction as said upper arm is urged to rotate,*

*a sewing machine support platform having a front edge, a rear edge and side edges, said platform being pivotally connected to said lower arm at a pivot point intermediate the front and rear edges of said platform,*

*a lock member connected to and extending outwardly from an edge of said platform and being near the front edge of said platform,*

*lower use support means for supporting said platform in a lower use position in which the platform is aligned with and below the opening in the cabinet top, said lower use support means comprising lower catch means for releasably supporting said lock member, said platform being supported in said lower use position by said lower catch means and said lower arm,*

*upper use support means for support said platform in an upper use position in which the platform is aligned with the opening in the cabinet top and is at or near the level of the cabinet top, said upper use support means comprising upper catch means for releasably supporting said lock member,*

*said mechanism being movable to a storage position wherein the platform is positioned such that a sewing machine attached thereto would be disposed below the cabinet top,*

*a storage lock member connected to said platform and extending from an edge thereof and receivable in locked position between said upper arm and said lower arm when the mechanism is in the storage position so as to prevent said platform from rotating relative to said lower arm, and*

*a pair of brackets connected to said cabinet, a second rod connected to one of said upper support arm and said brackets and pivotally connected to the other of said upper support arm and said brackets so as to pivotally connect said upper support arm to said cabinet top, and second spring means coiled around said second rod and connected to said upper arm for urging said upper arm in a direction causing said platform to move upwardly toward the upper use position.*

*38. In a sewing machine cabinet having a top with an opening therein, a mounting mechanism for supporting a free arm sewing machine selectively in an upper use position, a lower use position, and a storage position, said mechanism comprising:*

*an upper arm having an upper end and a lower end and pivotally connected to and depending from said cabinet top,*

*a lower support arm,*

*means for pivotally connecting said lower arm to said upper arm at a pivot point along said upper arm intermediate its ends, said connecting means comprising a yoke connected to said lower arm and pivotally connected to said upper arm, said yoke straddling the portion of said upper arm between said pivot point and said upper arm lower end,*

*a sewing machine support platform having a front edge, a rear edge and side edges, said platform being pivotally connected to said lower arm at a pivot point intermediate the front and rear edges of said platform,*

*a lock member connected to and extending outwardly from an edge of said platform and being near the front edge of said platform,*

*lower use support means for supporting said platform in a lower use position in which the platform is aligned with and below the opening in the cabinet top, said lower use support means comprising lower catch means for releasably supporting said lock member, said platform being supported in said lower use position by said lower catch means and said lower arm,*

*upper use support means for supporting said platform in an upper use position in which the platform is aligned with the opening in the cabinet top and is at or near the level of the cabinet top, said upper use support means comprising upper catch means for releasably supporting said lock member,*

*said mechanism being movable to a storage position wherein the platform is positioned such that a sewing machine attached thereto would be disposed below the cabinet top, and*

*a storage lock member connected to said platform and extending from an edge thereof and receivable in locked position between said upper arm and said lower arm when the mechanism is in the storage position so as to prevent said platform from rotating relative to said lower arm.*

* * * * *